US007857068B2

(12) United States Patent
Wagner

(10) Patent No.: US 7,857,068 B2
(45) Date of Patent: Dec. 28, 2010

(54) INERTIZATION DEVICE WITH SAFETY DEVICE

(75) Inventor: Ernst-Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 534 days.

(21) Appl. No.: 11/874,589

(22) Filed: Oct. 18, 2007

(65) Prior Publication Data

US 2008/0156505 A1 Jul. 3, 2008

(30) Foreign Application Priority Data

Oct. 19, 2006 (EP) ..... 06122588

(51) Int. Cl.
*A62C 35/00* (2006.01)

(52) U.S. Cl. ..... 169/11

(58) Field of Classification Search ..... 169/11, 169/43, 45, 46, 54, 56; 62/78, 640, 641, 62/643; 128/200.24, 202.12, 205.11; 252/2
See application file for complete search history.

(56) References Cited

U.S. PATENT DOCUMENTS

2001/0029750 A1 10/2001 Kotliar

FOREIGN PATENT DOCUMENTS

| | | | |
|---|---|---|---|
| DE | 198 11 851 | A1 | 9/1999 |
| EP | 1 683 548 | A | 7/2006 |
| WO | WO 03/066169 | A | 8/2003 |

*Primary Examiner*—Davis Hwu
(74) *Attorney, Agent, or Firm*—Fraser Clemens Martin & Miller LLC; J. Douglas Miller

(57) ABSTRACT

The invention relates to an inertization device for establishing and maintaining a presettable inertization level in a protective room. The inertization device has an inert gas system for providing inert gas, a supply pipe system connected to the inert gas system for supplying the inert gas to the protective room, and an inert gas system control unit for controlling the inert gas system. The rate the inert gas rate is provided determines a level of inertization inside the protective room. In order for the inert gas rate supplied to the protective room to be appropriately controlled, even in the event of a disruption in the control of the inert gas system or in the event of a failure of the inert gas system control unit, a safety device is provided.

17 Claims, 2 Drawing Sheets

INERTIZATION DEVICE WITH SAFETY DEVICE

CROSS REFERENCE TO RELATED APPLICATION

This application claims the benefit of European Application 06122588.4 filed on Oct. 19, 2006, the disclosure of which is hereby incorporated herein by reference in its entirety.

FIELD OF THE INVENTION

The present invention relates to an inertization device for establishing and maintaining an inertization level that can be preset inside a protective room to be monitored, whereby the inertization device has a controllable inert gas system for providing inert gas, a supply pipe system connected to the inert gas system, which can be connected to the protective room in order to supply the inert gas provided by the inert gas system to the protective room, and an inert gas system control unit, which is configured to control the inert gas system such that an inert gas rate provided by the inert gas system assumes a level that is appropriate for establishing and/or maintaining a first presettable inertization level inside the protective room.

BACKGROUND OF THE INVENTION

Such an inertization device is known in principle from the prior art. For example, German Patent Specification DE 198 11 851 C2 describes an inertization device for reducing the risk of fire and for extinguishing fires in enclosed spaces. The known system is configured to decrease the oxygen concentration within an enclosed room (hereinafter called "protective room") to a base inertization level, which can be preset in advance, and in the event of a fire to rapidly further decrease the oxygen concentration to a specific full inertization level, thereby enabling the fire to be effectively extinguished with the smallest possible storage capacity required for inert gas tanks. For this purpose, the known device has an inert gas system that can be controlled via a control unit, and a supply pipe system that is connected to the inert gas system and to the protective room, via which the inert gas provided by the inert gas system is supplied to the protective room. The inert gas system can be either a steel cylinder battery, in which the inert gas is stored in compressed form or a system for generating inert gases.

In general, the functioning method of an inertization device for reducing the risk of fire and for extinguishing fires in enclosed spaces is based upon the knowledge, that in enclosed spaces that are visited only occasionally by humans or animals, and whose equipment reacts sensitively to the effects of water, the risk of fire can be countered by reducing the oxygen concentration in the relevant area in a sustained manner to a level of, for example, approximately 12 vol.-% under normal conditions. At this oxygen concentration, most combustible materials can no longer burn. The main areas of application include especially ADP areas, electrical switching and distribution spaces, enclosed facilities, and storage areas containing high-value commercial goods.

The prevention and/or extinguishing effect that results from the inertization process is based upon the principle of oxygen displacement. As is known, normal environmental air is made up of 21 vol.-% oxygen, 78 vol.-% nitrogen and 1 vol.-% other gases. In order to effectively decrease the risk that a fire will start in a protective room, the nitrogen concentration is further increased in the relevant space by introducing inert gas, such as nitrogen, thereby decreasing the ratio of oxygen. With respect to extinguishing fire, it is known that an extinguishing effect is generated when the oxygen ratio drops below 15 vol.-%. Depending upon the combustible materials that are present inside the protective room, a further decrease in the oxygen ratio, for example to 12 vol.-%, may be necessary. In other words, with a sustained inertization of the protective room to a so-called "base inertization level," at which the oxygen ratio in the air inside the room is decreased, for example to below 15 vol.-%, the risk of a fire igniting inside the protective room can be effectively decreased.

The term "base inertization level" used herein is generally understood to refer to an oxygen concentration in the air inside the protective room that is reduced as compared with the oxygen concentration of normal environmental air, whereby, however, in principle this reduced oxygen concentration presents no danger of any kind to persons or animals, so that they are still able to enter the protective room with certain protective measures. As was already mentioned, the establishment of a base inertization level, which, in contrast to the so-called "full-inertization level", need not correspond to an oxygen ratio that is decreased such that fire is effectively extinguished, serves primarily to reduce the risk of a fire igniting within the protective room. The base inertization level corresponds to an oxygen concentration of, for example, 13 vol.-% to 15 vol.-%-depending upon the circumstances of the individual case.

In contrast, the term "full inertization level" refers to an oxygen concentration that is reduced further as compared with the oxygen concentration of the base inertization level, in which the flammability of most materials is already decreased so far, that they are no longer capable of igniting. Depending upon the fire load inside the protective room, the full inertization level generally ranges from 11 vol.-% to 12 vol.-% oxygen concentration.

Although the reduced oxygen concentration which corresponds to the base inertization level in the air inside the protective room presents no danger to persons and animals in principle, so that they can safely enter the protective room, at least for short periods of time, without significant hardships, for example without gas masks, certain nationally stipulated safety measures must be adhered to in entering a room that has been rendered inert in a sustained fashion to a base inertization level, because, in principle, a stay in a reduced oxygen atmosphere can lead to an oxygen deficiency, which under certain circumstances can have physiological consequences in the human organism. These safety measures are prescribed in the respective national regulations, and are dependent especially upon the level of the reduced oxygen concentration that corresponds to the base inertization level.

In the following Table 1, these effects on the human organism and on the combustibility of materials are presented.

In order to fulfill the safety measures with respect to the accessibility of the protected room stipulated in the national regulations, which become more strict as the oxygen ratio in the air inside the protective room decreases, in a simple manner that is especially easy to implement, it would be conceivable for the purpose of and for the duration of passage into the room to raise the sustained inertization of the protective room from the base inertization level to a so-called accessibility level, at which the stipulated safety requirements are lower and can be fulfilled without major inconvenience.

TABLE 1

| Oxygen ratio inside the protective room | Effect on the human organism | Effect on the combustibility of materials |
|---|---|---|
| 8 vol.-% | Risk to life | Not combustible |
| 10 vol.-% | Discernment and sensitivity to pain diminish | Not combustible |
| 12 vol.-% | Fatigue, elevation of respiratory volume and pulse | Difficult to ignite |
| 15 vol.-% | None | Difficult to ignite |
| 21 vol.-% | None | None |

For example, in a protective room that under normal conditions is permanently inertized to a base inertization level of, for example, 13.8 to 14.5 vol.-%, at which, according to Table 1, an effective suppression of fire can be achieved, it would make sense to reduce the oxygen ratio to an accessibility level, for example of 15 to 18 vol.-%, when it is to be entered, for example for maintenance purposes.

From a medical point of view, a temporary stay in an oxygen atmosphere that has been reduced to this accessibility level is safe for persons who have no cardiac, circulatory, vascular or respiratory illnesses, so that the respective national regulations governing this require no, or only minor, additional safety measures.

Ordinarily, raising the inertization level established inside the protective room from the base inertization level to the accessibility level is accomplished via a corresponding control of the inert gas system. In that regard, it is practical, especially for economic reasons, to consistently maintain the inertization level established inside the protective room at the accessibility level during passage into the protective room (for instance with a corresponding control range), in order to minimize the quantity of inert gas to be introduced back into the protective room once the visit has been completed, in order to reestablish the base inertization level. For this reason, the inert gas system should also be generating and/or providing inert gas during the period of passage into the protective room, so that the inert gas will be correspondingly supplied to the protective room in order to maintain the inertization level there at the accessibility level (optionally with a specific control range).

In the process it is noted, that the term "accessibility level" used herein refers to an oxygen concentration in the air inside the protective room which is reduced in comparison with the oxygen concentration of the normal ambient air, at which the respective national guidelines require no, or only minor, supplementary safety measures for passage into the protective room. As a rule, the accessibility level corresponds to an oxygen ratio in the room air that is higher than a base inertization level.

It is known that the inert gas rate to be provided by the inert gas system can be dependent especially upon the inertization level to be established inside the protective room (accessibility level, base inertization level, full inertization level) and the air exchange rate inside the protective room, but also upon other parameters, such as the temperature or the pressure inside the protective room.

Accordingly, it is necessary for the inert gas system installed inside the inertization device to be configured so as to be capable of providing inert gas at any time, so that a preset inertization level can be maintained inside the protective room. In particular, the inert gas system should be capable of providing inert gas at different inert gas rates at any time, based upon the respective requirements, to be able to compensate for leakage from the protective room, possible inert gas losses via air conditioning units and/or ventilation systems inside the protective room or by the removal of goods from the protective room. On the other hand, the inert gas system should be configured in terms of its capacity, such that it is able to provide a sufficient inert gas rate so that a preset inertization level can be restored within a desired time interval.

Ordinarily, a suitable inert gas system for this purpose is one that can be controlled via an inert gas system control unit, whereby the inert gas rate provided by the inert gas system can be correspondingly controlled via the inert gas system control unit.

SUMMARY OF THE INVENTION

The present invention is thus based upon the fact that, in the event of a disruption in the control of such an inert gas system control unit, or in the event of a failure of the inert gas system control unit, it cannot be ensured that, for example, at the time of entry into the protective room, the inertization level inside the protective room can be reliably maintained at the previously established accessibility level. This is problematic especially when, during entry into the protective room, the inert gas rate provided by the inert gas system is greater than the inert gas rate required to maintain the accessibility level. In such a case the oxygen ratio in the air inside the protective room would namely drop below the accessibility level, at which passage into the protective room would be unsafe from a medical standpoint.

Accordingly, the object of the present invention is to further improve upon an inertization device of the type described at the beginnings such that it can be reliably ensured that, for passage into a protective room which under normal circumstances is rendered inert in a sustained manner at a base inertization level, the inertization level established inside the protective room can also be reliably held at the accessibility level in the event of a disruption of the control of the inert gas system control unit or a failure of the inert gas system control unit.

Expressed in general terms, the objective of the present invention is to propose an inertization device with which a presettable inertization level can be reliably established and maintained inside a protective room to be monitored, even in the event of an error and/or failure of an inert gas system control unit, or in a case in which the inert gas system control unit is not configured to regulate the inert gas rate provided by the inert gas system with sufficient resolution and/or precision.

This objective is attained with an inertization device of the type mentioned at the beginning, such that the inertization device further manifests a safety device, which is configured to regulate the inert gas rate supplied to the protective room in the event of a disruption in the control of the inert gas system or in the event of a failure of the inert gas system control unit in such a manner that a second presettable inertization level is established and/or maintained inside the protective room.

In this connection, the terms "disruption in the control of the inert gas system" and "failure of the inert gas system control unit" refer generally to a condition in which the inert gas system control unit and/or the inert gas system—for whatever reason—are not capable, or in principle are not configured such that an inert gas rate that is necessary to establish and/or maintain a preset inertization level as precisely as possible can be provided by the inert gas system.

The advantages of the solution of the invention are obvious: Especially the provision of a safety device which preferably functions independently of the inert gas system control unit continuously ensures, even in the event of a disruption, that a specific, pre-established inertization level in the air atmosphere inside the protective room is established and/or precisely maintained. Thus, for example, in a case in which it is necessary for persons to enter the protective room, it is possible for the protective room to be freely entered without danger and especially without symptoms. In addition, with the solution of the invention it can be prevented, that the sustained inertization of the protective room is fully neutralized for the entire duration of the visit. As already indicated, a complete neutralization of the sustained inertization would be disadvantageous, especially from an economic standpoint, because in such a case, for example after entry into the protective room, an increased quantity of inert gas would have to be provided by the inert gas system, in order to reestablish, for example, the base inertization level inside the protective room.

In other words, the solution of the invention provides a safety measure for protective rooms, in order to ensure that, in principle, in a protective room that has been inertized to an accessibility level, no oxygen concentration which is dangerous to persons is reached, even if the nitrogen system should not cease introducing inert gas, due to an error (for example in control), or if the nitrogen system should not be fundamentally configured to provide inert gas at a reduced rate that is different from zero.

At the same time, with the solution according to the invention it is ensured, that the nitrogen system is configured to supply a sufficient volume flow to be capable of restoring and permanently maintaining the base inertization level within a desired amount of time, for example after passage into the protective room is complete. As was already indicated, the inert gas system must be capable of providing an inert gas rate, in order to compensate for leakages from the room, and possible losses via the air conditioning system or via the removal of goods.

However, the solution of the invention is suitable not only for reliably maintaining and/or establishing an accessibility level inside the protective room despite a disruption in the control of the inert gas system, rather any inertization level to be established inside the protective room, for example either a base inertization level or a full inertization level, can be reliably maintained with the safety device.

Advantageous further improvements on the invention are disclosed in the sub-claims.

Thus it is especially preferably proposed with respect to the safety device that, in a case in which the second presettable inertization level must be established and/or maintained inside the protective room, the safety device will reduce the maximum inert gas rate supplied to the protective room, such that the oxygen concentration inside the protective room cannot drop below the second presettable inertization level. The reduction in the maximum inert gas rate supplied to the protective room can take place, for example, in that the performance capacity of the inert gas system is correspondingly limited to a suitable extent, even if the control unit and/or sensors (especially volume flow sensors and/or inert gas and/or oxygen sensors) should fail. If, for example, the second presettable inertization level is the accessibility level, it can be ensured with the solution of the invention that at the time of passage into the protective room, the oxygen concentration in the atmosphere inside the room in principle cannot assume a level that is injurious to one's health, even if the control of the inert gas system is disrupted.

In a particularly preferred implementation of the safety device, it is provided, that said device has at least a first controllable shut-off valve, allocated to the supply pipe system, for breaking the connection that can be produced between the inert gas system and the protective room via the supply pipe system, at least one bypass pipe system with a second controllable shut-off valve for producing a bypass connection between the inert gas system and the protective room, and a safety device control unit, whereby the safety device control unit is configured to close the first shut-off valve and to open the second shut-off valve in the event of a disruption of the control of the inert gas system or in the event of a failure of the inert gas system control unit, and whereby the bypass pipe system, which bypasses the first controllable shut-off valve, is configured to regulate the inert gas rate supplied to the protective room via the bypass pipe system, such that the second presettable inertization level is established and/or maintained inside the protective room. This advantageous implementation of the safety device is characterized especially by its simple construction, which especially also simplifies the retrofitting of conventional inertization systems with such a safety device. Specifically, with only a slight structural and financial expenditure, conventional inertization systems can be correspondingly retrofitted.

On the other hand, the safety device is comprised of only a few components that are known in principle from the prior art and have been tested, which is advantageous not only for cost reasons, but also ensures a reliable functioning of the safety device. In this, it would be conceivable to integrate the safety device control unit as a control module, for example as an auxiliary software module, into the already existing inert gas system control unit. Of course, it is also conceivable to provide the safety device control unit separately from the inert gas system control unit.

In principle, however, it should be possible for an operator to preset the inertization level to be established and maintained inside the protective room into the inert gas system control unit. However, it would also be possible for the control unit to control the inert gas system independently, for example according to a preset sequence of events, in order to establish the desired inertization level inside the protective room. With respect to the safety device control unit which is associated with the safety device, it must be ensured that it can communicate with the inert gas system control unit, in order to control the corresponding shut-off valves in the event of a breakdown.

With respect to the first and the second shut-off valves, it is noted, that these two valve units can be provided as separate components in the inertization device; however, it would also be possible to use a three-way valve arrangement, which as a single component assumes the functions of the first and second shut-off valves. Suitable valve arrangements are known from the prior art and will not be described in greater detail here.

With respect to the bypass pipe system according to the latter preferred implementation of the safety device of the invention, it would be conceivable for this to have a section with an effective flow area, which is configured to regulate the inert gas rate supplied to the protective room via the bypass pipe system such that the second presettable inertization level is established and/or maintained inside the protective room. Thus it is conceivable, for example, for the aforementioned section of the bypass pipe system, which is either limited to only one area of the bypass pipe system or extends over the entire bypass pipe system, to be firmly adjusted in advance to the air exchange rate inside the protective room with respect to its effective flow area. Assuming it is known which inert gas rate must be supplied to the protective room in order to maintain a certain inertization level, for example the accessibility level or the base inertization level, it is therefore possible to dimension the section of the bypass pipe system accordingly in advance, so that this section adjusts the inert gas quantity supplied to the protective room via the bypass pipe system at a certain inertization level.

Of course it is conceivable, however, for the effective flow area of the section of the bypass pipe system to be adjustable via the safety device control unit, in order to better adjust the inert gas rate supplied to the protective room via the bypass pipe system to the air exchange rate inside the protective room. Additionally, this further improvement according to the invention, in which the effective flow area of the section can be adjusted, is characterized in that in the protective room different inertization levels, which can be preset in advance by the user, can be established and/or especially precisely maintained.

In an especially preferred implementation with respect to the bypass pipe system, it is provided that this has a volume flow regulator which can be controlled via the safety device control for limiting the inert gas rate supplied to the protective room via the bypass pipe system. In the process, the volume flow regulator assumes the function of a flow restrictor, so that the inert gas rate supplied to the protective room via the bypass pipe system can be adjusted in a simple but effective manner. The technical implementation of the volume flow regulator will not be discussed here in detail. In principle, all devices known from the prior art which can serve to adjust a fluid volume flow can be used.

In order to achieve that the inertization level to be established inside the protective room can be established and/or maintained as precisely as possible by supplying a suitable inert gas quantity and/or via a regulated supply of, for example, fresh air or oxygen from the surrounding atmosphere, it is preferably provided that the inertization device further has at least one oxygen detection device for detecting the oxygen ratio in the air inside the protective room, whereby the inert gas system control unit and/or the safety device control unit are configured to adjust the inert gas rate supplied to the protective room based upon the oxygen ratio measured in the air inside the protective room. It would hereby be conceivable for the oxygen detection device to emit a corresponding signal to the appropriate control units, continuously or at preset time intervals, as a result of which either the inert gas system or the volume flow regulator is correspondingly controlled, in order to always supply to the protective room the inert gas rate that is necessary to maintain the inertization level established inside the protective room.

At this point it is mentioned, that an expert will recognize, that the term "maintaining the oxygen concentration at a certain inertization level", used herein, refers to maintaining the oxygen concentration at the inertization level with a certain control range, whereby said control range preferably can be selected based upon the type of protective room (for example based upon an air exchange rate that is valid for the protective room or based upon the materials stored inside the protective room) and/or based upon the type of inertization system or safety device used. Typically, a control range of this type extends from ±0.1 to 0.4 vol.-%. Of course other control range levels are also conceivable.

In addition to the aforementioned continuous and/or regular measurement of the oxygen concentration, however, the oxygen concentration can be maintained at the presettable, established inertization level based upon a calculation performed in advance, whereby in this calculation certain design parameters for the protective room should be used, such as, for example, the air exchange rate that is valid for the protective room, especially the $n_{50}$ value for the protective room, and/or the pressure difference between the protective room and the surrounding air.

As the oxygen detection device, an aspiration-type device is especially well suited. With such a device, representative samples are continuously taken from the air inside the protective room to be monitored and are supplied to an oxygen detector, which emits a corresponding detection signal to the appropriate control unit. Of course it would also be possible, however, to perform an oxygen measurement that functions without contact (optical) as the oxygen detection device. PSP measuring technology (PSP=Pressure Sensitive Paint) is particularly well suited for this. An optical measuring process that functions without contact for detecting the oxygen concentration inside the protective room would especially be used in rooms which, due to their configuration, for example, cannot be additionally equipped with conventional (especially wire-connected) oxygen detectors.

With respect to the failure safety of the solution of the invention, it is finally preferably provided, that the oxygen detection device has a multitude of parallel operating oxygen detectors, whereby the inert gas system control unit and/or the safety device control unit are configured to adjust the inert gas rate supplied to the protective room based upon each of the oxygen ratios measured in the air inside the protective room by the respective oxygen detectors. In a preferred implementation, sensors are used for the multitude of parallel functioning oxygen sensors, which are based at least in part on various technologies for detecting the oxygen concentration in the air inside the protective room, such as paramagnetic sensors, zirconium dioxide sensors, PSP sensor systems, etc. It would in particular be conceivable here for the inert gas system control unit and/or the safety device control unit to be configured to emit a failure alarm and/or an emergency OFF signal for shutting off the inert gas system, when at least one oxygen detector displays an oxygen ratio in the air inside the protective room that, with respect to the oxygen ratios measured by the other oxygen detectors, has a deviation that exceeds a certain presettable value.

With one particularly preferred further improvement on the solution of the invention, it is provided, that the inert gas system has an ambient air compressor and an inert gas generator connected thereto, whereby the inert gas system control unit is configured to control the air flow rate of the ambient air compressor, such that the inert gas rate provided by the inert gas system is set at the level that is suitable for establishing and/or maintaining the first presettable inertization level. This solution, which is preferable with respect to the inert gas system, is especially characterized in that the inert gas system can generate the inert gas on-site, eliminating the necessity, for example, of providing a pressurized tank battery, in which the inert gas is stored in compressed form.

In any event, it would also be conceivable for the inert gas system to have a pressurized inert gas storage tank, whereby the inert gas system control unit should be configured so as to control a controllable pressure-reducing valve that is allocated to the pressurized inert gas storage tank and is connected to the supply pipe system, in order to set the inert gas rate provided by the inert gas system at the level which is appropriate for establishing and/or maintaining the presettable first inertization level. The pressurized inert gas storage tank can, however, be provided alone or also in combination with the aforementioned ambient air compressor and inert gas generator.

In a particularly preferred further improvement on the latter embodiment, in which the inert gas system has a pressurized inert gas storage tank, it is provided, that the inertization device further has a pressure-dependent valve device, which is opened in a first presettable pressure range, for example between 1 and 4 bar, permitting the pressurized inert gas storage tank to be filled via the inert gas system. It would furthermore be conceivable for the safety unit in this preferred further improvement to have a bypass pipe system that is connected to the pressurized inert gas storage tank.

As already mentioned, the solution according to the invention is not limited to establishing and/or maintaining the accessibility level inside the protective room in the event of a disruption in the control of the inert gas system. Rather, the claimed inertization device of the invention is configured such that the first and/or the second presettable inertization level is a full inertization level, a base inertization level or an accessibility level.

BRIEF DESCRIPTION OF THE DRAWINGS

Below, two embodiments of the inertization device of the invention will be described in greater detail with reference to the set of drawings. The drawings show.

DETAILED DESCRIPTION OF THE PREFERRED EMBODIMENT

Figure 1:
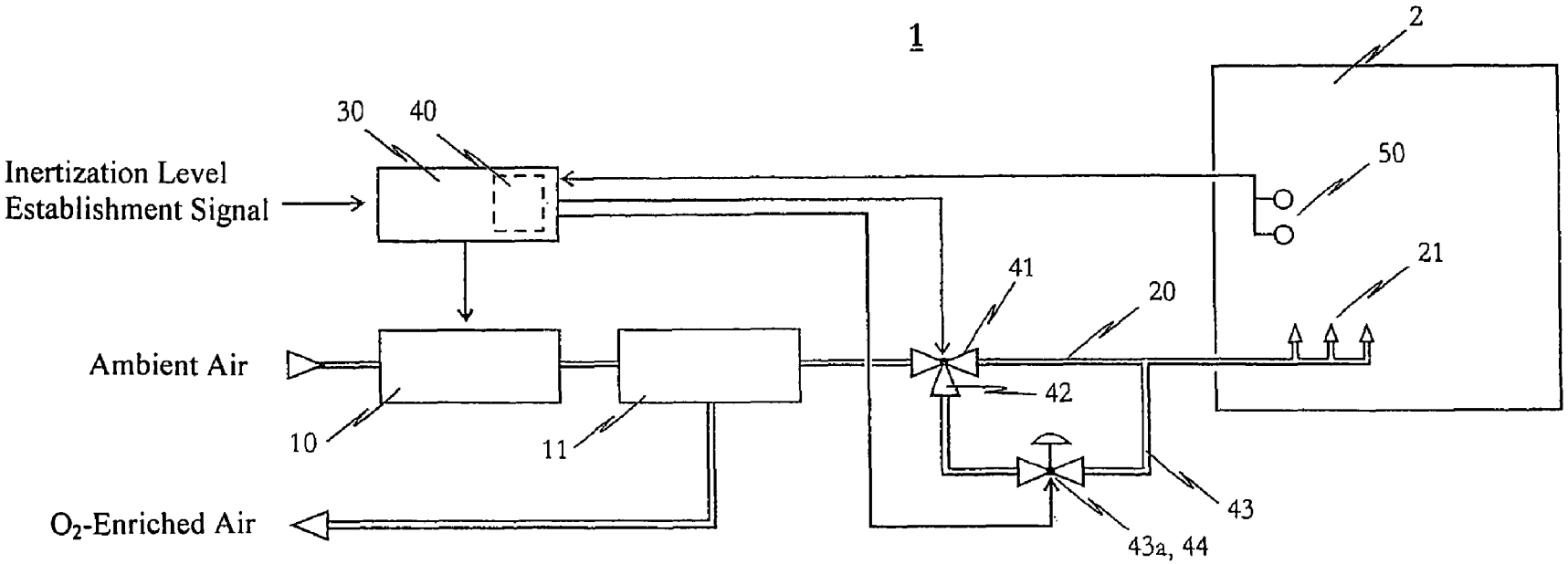
FIG. 1 illustrates a schematic view of a first preferred embodiment of the inertization device of the invention.

In FIG. 1, a first preferred embodiment of the inertization device 1 for establishing and maintaining a presettable inertization level inside a protective room 2 to be monitored is schematically represented. The inertization device 1 is comprised essentially of an inert gas system, which has an ambient air compressor 10 and an inert gas generator 11 connected thereto. Further, an inert gas system control unit 30 is provided, which is configured to control the air flow rate of the ambient air compressor 10 via corresponding control signals. In this manner, the inert gas rate provided by the inert gas system 10, 11 can be established, at least in part, via the inert gas system control unit 30.

The inert gas generated by the inert gas system 10, 11 is supplied via a supply pipe system 20 to a protective room 2 to be monitored; of course, multiple protective rooms can also be connected to the supply pipe system. Specifically, the supply of the inert gas provided by the inert gas system 10, 11 is supplied via corresponding outlet nozzles 21, which are arranged at a suitable site inside the protective room 2.

In the preferred embodiment of the solution of the invention, the inert gas, advantageously nitrogen, is obtained on-site from the surrounding air. The inert gas generator and/or nitrogen generator 11 functions, for example, according to the membrane or PSA technology known from the prior art, in order to generate nitrogen-enriched air having a 90 vol.-% to 95 vol.-% nitrogen ratio, for example. This nitrogen-enriched air serves in the preferred embodiment as inert gas that is supplied to the protective room 2 via the supply pipe system 20. The oxygen-enriched air that is created with the generation of the inert gas is removed via another pipe system to the outside.

Specifically, it is provided, that the inert gas system control unit 30 controls the inert gas system 10, 11, based upon an inertization signal which is input into the control unit 30 by the user, for example, such that the inert gas rate provided by this system 10, 11 assumes a level that is appropriate for establishing and/or maintaining the preset inertization level inside the protective room 2. The desired inertization level can be selected on the inert gas system control unit 30, for example via a keypad or on a password-protected, control panel (not specifically shown). Of course it is also conceivable here for the inertization level to be selected according to a preset sequence of events.

If, for example, the base inertization level is selected on the inert gas system control unit 30, which has been established in advance especially taking into account the characteristic values for the protective room 2, a three-way valve 41, 42, which is allocated to the supply pipe system 20, is switched to the direct conveyance of the inert gas into the protective room 2.

However, in the event it should be necessary for persons to enter the protective room 2, which is necessary, for example, when goods must be removed from the protective room 2 or when certain maintenance work must be performed inside the protective room 2, it is necessary to raise the sustained inertization inside the protective room 2 from the base inertization level to an accessibility level, so that passage into the protective room 2 will be safe from a medical standpoint, without special precautionary measures. As already indicated, the accessibility level corresponds to an oxygen ratio in the air inside the protective room 2 that is higher than the oxygen ratio that corresponds to the base inertization level. On the other hand—even when the accessibility level is established inside the protective room 2—a sustained inertization continues to be present inside the protective room 2, which is advantageous especially for economic reasons, since the quantity of inert gas required to re-establish the base inertization level can thus be minimized.

Now, if the accessibility level, which is preferably established in advance especially taking into account the characteristic values of the protective room 2, is selected on the inert gas system control unit 30, the inert gas system control unit 30 emits a corresponding signal to the three-way valve arrangement 41, 42, as a result of which the direct connection created via the supply pipe system 20 between the inert gas system 10, 11 and the protective room 2 is broken, so that the inert gas is re-routed to a bypass pipe system 43. As shown, the bypass pipe system 43 in the preferred embodiment serves to create a bypass connection between the inert gas system 10, 11 and the protective room 2, whereby the bypass connection bypasses the section of the supply pipe system 20 that is controlled via the controllable shut-off valve (first controllable shut-off valve 41) that is allocated to the supply pipe system 20.

It should further be recognized, that the bypass pipe system 43, after bypassing the shut-off valve 41 which is allocated to the supply pipe system 20, again opens up into the supply pipe system 20, so that the inert gas which is supplied to the protective room 2 via the bypass pipe system 43 can be supplied via the same inert gas nozzles 21. Of course, it would also be conceivable for the bypass pipe system 43 to have its own, separate inert gas nozzles in the protective room 2.

So that the inert gas rate which is supplied to the protective room 2 via the bypass pipe system 43 can be appropriately adjusted to the inertization level that is to be established and maintained inside the protective room 2, independently of the control of the inert gas system 10, 11 which is caused by the inert gas system control unit 30, a controllable volume flow regulator 44 is allocated to the bypass pipe system 43 in a section 43*a* of the bypass pipe system 43. This volume flow regulator 44 serves to limit the inert gas rate that is supplied to the protective room 2 via the bypass pipe system 43.

Specifically, the volume flow regulator 44 can be appropriately controlled either via the inert gas system control unit 30 or via a safety device control unit 40 that is independent of the inert gas system control unit 30. In the preferred embodiment, the safety device control unit 40 is configured as an independent control module in the inert gas system control unit 30. Of course, it would also be conceivable to provide the two control units 30, 40 spatially separated from one another in different hardware modules.

In principle, both the inert gas system control unit 30 and the safety device control unit 40 are configured such that in these, the user can input a desired inertization level. Based upon the preset inertization level, and preferably also based upon the oxygen ratio in the air inside the protective room 2 detected via an oxygen detection device 50, the inert gas system 10, 11 and/or the volume flow regulator 44 are correspondingly controlled via the control units 30 and/or 40, so that the inert gas rate which is necessary to establish and maintain the preset inertization level can be supplied to the protective room 2.

The solution of the invention, as represented by way of example in a first embodiment in FIG. 1, is in particular characterized in that with the three-way valve 41, 42, the bypass pipe system 43 and the volume flow regulator 44 which can be controlled via the safety device control unit 40, a safety device control unit is made available, which in principle adjusts the inert gas rate supplied to the protective room 2, in the event of a disruption in the control of the inert gas system 10, 11 via the inert gas system control unit 30, or in the event of a failure of the inert gas system control unit, such that the preset inertization level inside the protective room 2, for example the base inertization level or the accessibility level, can be reliably established and/or precisely maintained.

Of course it is also conceivable, however, for the safety device to always be activated when the permanently inertized protective room 2 is to be raised from the base inertization level to an accessibility level, or, expressed in general terms, when a change in inertization level is to be performed. This would be practical, for example, when the inert gas system 10, 11 cannot be controlled with sufficient resolution via the inert gas system control unit 30, in order to precisely adjust the inert gas rate provided by the inert gas system 10, 11 to the respective requirements. This would be the case, for example, if the inert gas system can only be switched on and off via the inert gas system control unit 30. Because in establishing an accessibility level inside the protective room 2 a certain (although optionally reduced) inert gas quantity must be supplied continuously or at specific time intervals in order to maintain the accessibility level established therein (optionally with a specific control range), it is not sufficient for the inert gas system 10, 11 to be completely shut off at the time of passage into the protective room. Rather, it is necessary for the inert gas system to provide inert gas nearly continuously. Thus switching off the inert gas system 10, 11 would not be an option for passage into the protective room 2.

In such a case, i.e. when only the inert gas system 10, 11 can be switched on or off via the inert gas system control unit 30, during the time in which, for example, the accessibility level is established, the quantity of inert gas which is necessary for the protective room 2 must be established and supplied via the safety device.

Figure 2:
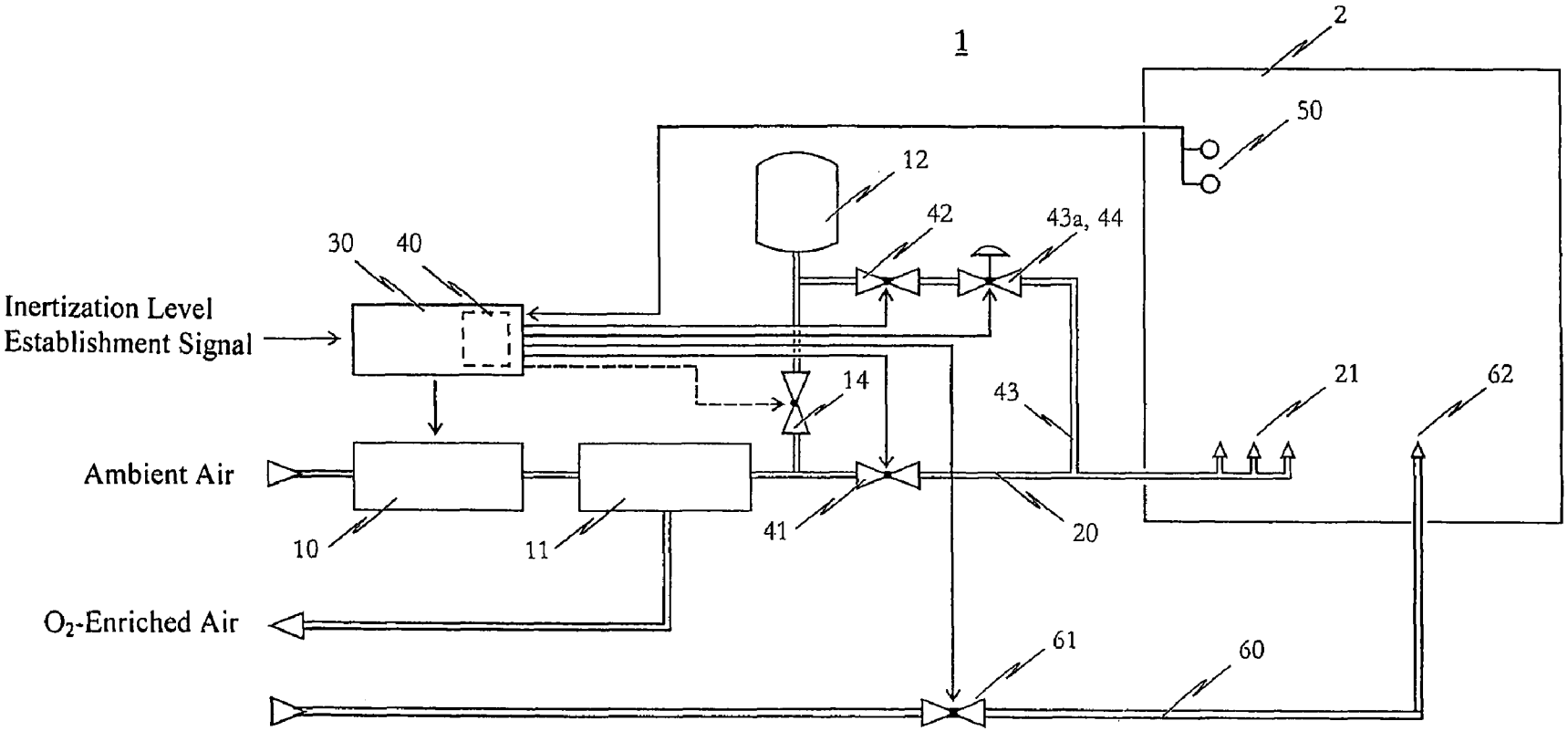
FIG. 2 illustrates a schematic view of a second preferred embodiment of the inertization device of the invention.

In FIG. 2 a second preferred embodiment of the inertization device 1 of the invention is shown. In this embodiment, the valve assembly that is represented in FIG. 1 as a three-way valve 41, 42 is configured as two separate two-way valve assemblies 41 and 42. In this a first shut-off valve 41, which can be controlled via the inert gas system control unit 30 and/or via the shut-off valve 41 which is allocated to the safety device control unit is allocated to the supply pipe system 20, in order to break the connection that can be produced via the supply pipe system 20 between the inert gas system 10, 11 and the protective room 2. Further, a second shut-off valve 42, which can preferably be controlled via the safety device control unit 40, is allocated to the bypass pipe system 43, for creating a bypass connection between the inert gas system 10, 11 and the protective area 2, whereby the bypass connection bypasses the first controllable shut-off valve 41. Just as with the first preferred embodiment according to FIG. 1, a controllable volume flow regulator 44 is provided in the bypass pipe system 43.

In contrast to the first preferred embodiment, in the second embodiment shown in FIG. 2, a pressurized inert gas storage tank 12 is also allocated to the inert gas system 10, 11. This pressurized storage tank 12 is connected to the inert gas generator 11 of the inert gas system via a preferably pressure-dependent valve unit 14. This pressure-dependent valve unit 14 is preferably configured such that it is opened in a first presettable pressure range, for example up to a pressure of 4 bar, permitting the pressurized inert gas storage tank 12 to be filled via the inert gas system 10, 11.

By providing a pressurized inert gas storage tank 12 of this type it is possible for inert gas generated continuously by the inert gas system 10, 11 to be stored temporarily, for example, when the quantity of inert gas required to establish and/or maintain a presettable inertization level is lower than the inert gas quantity actually generated and/or provided at that time.

Of course it would also be conceivable, however, for the pressure-dependent valve unit 14 to be correspondingly controlled via the control unit 30, 40; therefore, in FIG. 2 a dashed signal line is shown, indicating this.

It is also optionally conceivable for the inertization device to have a fresh air supply unit 60, via which fresh air and/or oxygen can be supplied in a controlled fashion to the protective room 2, thereby establishing and/or maintaining a preset inertization level inside the protective room 2. It would be conceivable in this regard for the fresh air supply device 60 to have a correspondingly controllable valve 61, which is opened and/or closed via the control unit 30 or 40, as needed. The fresh air supply device 60 can have a nozzle system 62 that is separate from the inert gas supply nozzle system 21, as shown in FIG. 2; however, it would also be possible for the fresh air supply device 60 to use the inert gas supply nozzle system 21.

It is noted, that the implementation of the invention is not limited to the exemplary embodiments described in FIGS. 1 and 2, but is instead possible in a multitude of variants.

From the foregoing description, one ordinarily skilled in the art can easily ascertain the essential characteristics of this invention and, without departing from the spirit and scope thereof, can make various changes and modifications to the invention to adapt it to various usages and conditions.

| List of Reference Symbols | |
|---|---|
| 1 | Inertization device |
| 2 | Protective room |
| 10 | Inert gas system; ambient air compressor |
| 11 | Inert gas system; inert gas generator |
| 12 | Pressurized inert gas storage tank |
| 14 | Pressure-dependent valve unit |
| 20 | Supply pipe system |
| 21 | Inert gas nozzles |
| 30 | Inert gas system control unit |
| 40 | Safety device control unit |
| 41 | First controllable shut-off valve |
| 42 | Second controllable shut-off valve |
| 43 | Bypass pipe system |

-continued

| List of Reference Symbols | |
|---|---|
| 43a | Section of bypass pipe system |
| 44 | Volume flow regulator |
| 50 | Oxygen detection device |
| 60 | Fresh air supply unit |
| 61 | Controllable shut-off valve |
| 62 | Fresh air supply nozzle |

FIG. 1, 2, 3

Inertisierungsniveau Einstellsignal=Inertization Level Establishment Signal

Umgebungsluft=Ambient Air $O_2$-angereicherte Luft=$O_2$-Enriched Air

What is claimed is:

1. An inertization device for a protective room, the inertization device comprising:

an inert gas system for supplying an inert gas;

a supply pipe system providing fluid communication between the inert gas system and the protective room;

a control unit adapted to control the inert gas system to facilitate supplying the inert gas to the protective room for at least one of establishing and maintaining the protective room at a first inertization level and a second inertization level; and a safety device adapted to control a rate the inert gas is supplied to the protective room for the at least one of establishing and maintaining the protective room at the first inertization level and the second inertization level, wherein the safety device further comprises: a bypass pipe system providing fluid communication between the supply pipe system and the protective room; a first control valve disposed in the supply pipe system for selectively supplying the inert gas to the protective room and the bypass pipe system; a second control valve disposed in the bypass pipe system for selectively permitting and militating against a flow of the inert gas therethrough; and a safety device control unit adapted to selectively control the first control valve and the second control valve, wherein the safety device control unit controls the second control valve to control the rate the inert gas is supplied to the protective room for the at least one of establishing and maintaining the protective room at the second inertization level.

2. The inertization device according to claim 1, wherein the safety device reduces the rate the inert gas is supplied to the protective room for the at least one of establishing and maintaining the protective room at the second inertization level.

3. The inertization device according to claim 1, wherein the second control valve is a volume flow regulator adapted to be controlled by the safety device control unit, wherein the volume flow regulator controls the inert gas being supplied to the protective room through the bypass pipe system.

4. The inertization device according to claim 3, further comprising an oxygen detection device for detecting an oxygen ratio in the air inside the protective room, wherein at least one of the inert gas system control unit and the safety device control unit is adapted to control the rate the inert gas is supplied to the protective room responsive to the oxygen ratio measured in the air inside the protective room.

5. The inertization device according to claim 4, wherein the oxygen detection device includes a plurality of oxygen detectors, wherein at least one of the inert gas system control unit and the safety device control unit is adapted to control the rate the inert gas is supplied to the protective room based upon each of the oxygen ratios measured by the oxygen detectors in the air inside the protective room.

6. The inertization device according to claim 1, further comprising a fresh air supply device for selectively supplying at least one of air and oxygen into the protective room, wherein the fresh air supply device is controlled by at least one of the inert gas system control unit and the safety device control unit based upon the oxygen ratio in the air inside the protective room.

7. The inertization device according to claim 1, wherein the inert gas system includes a compressor and an inert gas generator in fluid communication therewith, wherein the inert gas system control unit controls a rate of the air flow from the compressor to the inert gas generator.

8. The inertization device according to claim 1, wherein the inert gas system includes an inert gas storage tank and a controllable pressure-reducing valve in fluid communication with the inert gas storage tank and the supply pipe system, and wherein the inert gas system control unit is adapted to control the pressure-reducing valve to control the rate the inert gas is supplied to the inert gas system.

9. An inertization device for a protective room, the inertization device comprising:

an inert gas system for supplying an inert gas;

a supply pipe system providing fluid communication between the inert gas system and the protective room to supply the inert gas from the inert gas system to the protective room;

a control unit adapted to control the inert gas system to facilitate at least one of establishing and maintaining the protective room at a first presettable inertization level and a second presettable inertization level; and a safety device adapted to control a rate the inert gas is supplied to the protective room during at least one of a disruption of control of the inert gas system and a failure of the inert gas system control unit, wherein the second presettable inertization level is at least one of established and maintained inside the protective room, wherein the safety device comprises: a bypass pipe system providing fluid communication between the supply pipe system and the protective room; a first control valve disposed in the supply pipe system for selectively supplying the inert gas to the protective room and the bypass pipe system; a second control valve disposed in the bypass pipe system for selectively permitting and militating against a flow of the inert gas therethrough; and a safety device control unit adapted to selectively control the first control valve and the second control valve, wherein the safety device control unit controls the second control valve during the at least one of a disruption of control of the inert gas system and a failure of the inert gas system control unit to control the rate the inert gas is supplied to the protective room for the at least one of establishing and maintaining the protective room at the second inertization level.

10. The inertization device according to claim 9, wherein the bypass pipe system has a section with an effective flow area adapted to regulate the rate the inert gas is flowing through the bypass pipe system for the at least one of establishing and maintaining the protective room at the second inertization level.

11. The inertization device according to claim 10, whereby the effective flow area is adjustable by the safety device control unit.

12. The inertization device according to claim 11, wherein the bypass pipe system includes a volume flow regulator disposed therein controlled by the safety device control unit, wherein the volume flow regulator limits the rate the inert gas is supplied to the protective room through the bypass pipe system.

13. The inertization device according to claim 12, further comprising at least one oxygen detection device disposed in the protective room for detecting the oxygen ratio in air in the protective room, wherein at least on of the inert gas system control unit and the safety device control unit is configured to adjust the rate the inert gas is supplied to the protective room based upon the oxygen ratio measured in air in the protective room.

14. The inertization device according to claim 9, wherein at least one of the inert gas system control unit and the safety device control unit emits an alarm signal when the oxygen detection device detects an oxygen ratio in air inside the protective room deviates from a preset value.

15. The inertization device according to claim 9, wherein the inert gas system includes a compressor and an inert gas generator in fluid communication therewith, wherein the inert gas system control unit controls a rate of the air flow from the compressor to the inert gas generator.

16. The inertization device according to claim 9, wherein the inert gas system includes an inert gas storage tank and a controllable pressure-reducing valve in fluid communication with the inert gas storage tank and the supply pipe system, and wherein the inert gas system control unit is adapted to control the pressure-reducing valve to control the rate the inert gas is supplied to the inert gas system.

17. The inertization device according to claim 9, wherein the first inertization level is a full inertization level and the second inertization level is an accessibility level.

* * * * *